US009645546B2

(12) United States Patent
Wang et al.

(10) Patent No.: US 9,645,546 B2
(45) Date of Patent: May 9, 2017

(54) STORAGE CHIP, IMAGING CARTRIDGE, METHOD OF CHANGING SERIAL NUMBER AND METHOD OF USING STORAGE CHIP

(71) Applicant: APEX MICROELECTRONICS CO., LTD., Zhuhai (CN)

(72) Inventors: Dongjie Wang, Zhuhai (CN); Yanqing Yuan, Zhuhai (CN)

(73) Assignee: APEX MICROELECTRONICS CO., LTD., Guangdong (CN)

( * ) Notice: Subject to any disclaimer, the term of this patent is extended or adjusted under 35 U.S.C. 154(b) by 0 days.

(21) Appl. No.: 15/077,807

(22) Filed: Mar. 22, 2016

(65) Prior Publication Data

US 2016/0202662 A1 Jul. 14, 2016

Related U.S. Application Data

(63) Continuation of application No. PCT/CN2014/075519, filed on Apr. 16, 2014.

(30) Foreign Application Priority Data

Sep. 23, 2013 (CN) ..... 2013 1 0466060
Nov. 21, 2013 (CN) ..... 2013 1 0615537

(51) Int. Cl.
*G03G 21/18* (2006.01)
*B41J 2/175* (2006.01)

(52) U.S. Cl.
CPC ..... *G03G 21/1875* (2013.01); *B41J 2/17546* (2013.01); *G03G 21/1878* (2013.01); *G03G 21/1882* (2013.01); *G03G 21/1892* (2013.01)

(58) Field of Classification Search
CPC ..... G03G 21/1875; G03G 21/1878; G03G 15/08; G03G 15/0863; G03G 2215/0695;
(Continued)

(56) References Cited

U.S. PATENT DOCUMENTS

2007/0127936 A1 6/2007 Miller ..... 399/12
2012/0134687 A1 5/2012 Jones et al. ..... 399/12
(Continued)

FOREIGN PATENT DOCUMENTS

CN 1753790 A 3/2006
CN 101913292 A 12/2010
(Continued)

OTHER PUBLICATIONS

International Search Report of corresponding International PCT Application No. PCT/CN2014/075519, dated Jul. 11, 2014.
(Continued)

*Primary Examiner* — Sophia S Chen
(74) *Attorney, Agent, or Firm* — J. C. Patents

(57) ABSTRACT

Provided are a storage chip, an imaging cartridge, a method for changing a serial number and a method of using the storage chip. The storage chip includes a communication unit, a control unit and a storage unit; the storage unit stores information of multiple different serial numbers and mark information or access mark information about whether a currently-selected serial number is legal; the control unit determines whether the serial number information sent to the imaging device is determined as legal according to a preset strategy and autonomously changes the selected serial number information when a preset condition is satisfied according to the determination result, so that the method of changing the serial number of the storage chip is more convenient, user experience is greatly improved and the problem that the storage chips are unusable because of the same serial number can be solved.

15 Claims, 3 Drawing Sheets

(58) Field of Classification Search
CPC ..... G03G 2215/0697; G03G 21/1882; G03G 21/1892; B41J 2/175; B41J 2/17546
USPC ..... 399/12; 347/86
See application file for complete search history.

(56) References Cited

U.S. PATENT DOCUMENTS

| | | | | |
|---|---|---|---|---|
| 2012/0303204 | A1* | 11/2012 | Narisako | F02D 41/22 701/29.6 |
| 2015/0110504 | A1* | 4/2015 | Lee | G03G 15/0863 399/12 |

FOREIGN PATENT DOCUMENTS

| | | | |
|---|---|---|---|
| CN | 101916062 | A | 12/2010 |
| CN | 102173233 | A | 9/2011 |
| CN | 102189810 | A | 9/2011 |
| CN | 102886987 | A | 1/2013 |
| CN | 103182852 | A | 7/2013 |
| CN | 103640339 | A | 3/2014 |
| EP | 1 170 132 | A2 | 1/2002 |
| JP | 07-323640 | A | 12/1995 |
| JP | 11-157059 | A | 6/1999 |
| JP | 11-194664 | A | 7/1999 |
| JP | 2004-078377 | A | 3/2004 |
| JP | 2006-030929 | A | 2/2006 |
| JP | 2006-272641 | A | 10/2006 |
| JP | 2008-015548 | A | 1/2008 |
| JP | 2011-141344 | A | 7/2011 |

OTHER PUBLICATIONS

Chinese First Examination Report of corresponding China Application No. 201310615537.4, dated Feb. 15, 2015.
The Japanese Examination Report of corresponding Japanese patent application No. 2016-516566, dated Dec. 27, 2016.

* cited by examiner

STORAGE CHIP, IMAGING CARTRIDGE, METHOD OF CHANGING SERIAL NUMBER AND METHOD OF USING STORAGE CHIP

CROSS-REFERENCE TO RELATED APPLICATIONS

This application is a continuation of International Application No. PCT/CN2014/075519, filed on Apr. 16, 2014, which claims priority to Chinese Patent Application No. 201310466060.8, filed on Sep. 23, 2013 and Chinese Patent Application No. 201310615537.4, filed on Nov. 21, 2013, all of which are hereby incorporated by reference in their entireties.

TECHNICAL FIELD

The present invention relates to the printing and imaging technology and, more particularly, to a storage chip, an imaging cartridge, and a method of using the storage chip.

BACKGROUND

With the development of the imaging technology, imaging devices, such as a laser printing device and an ink jet printing device etc have been widely applied. During imaging, the imaging device only can perform the imaging process with the aid of imaging auxiliary information of an imaging cartridge. The imaging auxiliary information of the imaging device is not only recorded in the imaging device, but also in a storage chip, as shown in FIG. 1, which is a schematic diagram of communication interaction between an imaging device and a storage chip in the prior art. Particularly, the storage chip is attached to (typically affixed to or embedded in) the imaging cartridge, the imaging cartridge can be an ink cartridge filled with ink or a toner cartridge filled with toner the function of the storage chip is to control matching between the imaging cartridge and the imaging device, and offer imaging auxiliary information in the subsequent imaging process. The storage chip performs information interaction with the imaging device via a communication interface (not shown) in the storage chip. The storage chip of the imaging cartridge is recorded with initial information of the imaging cartridge, including model color, recording material capacity, manufacturing date, manufacturer code of the imaging cartridge, as well as imaging auxiliary information in the subsequent printing process representing data of recording material residual/consumption. The storage chip plays major roles in identifying identities and providing a service condition of recording materials.

As the market competition becomes more and more fierce, and the imaging technology improves and popularizes, more and more compatible manufacturers begin to manufacture compatible imaging cartridges which can be comparable to the original imaging cartridge and also can be installed on the imaging device, and such kind of compatible imaging cartridges are popular among mass mid-and-low end consumers due to their low price. However, original manufacturers constantly update the storage chip on the imaging cartridge, so as to maintain their market shares, for example, to improve difficulty of the encryption algorithm, or to record a sequence number of the used storage chip in the imaging device, and the original manufacturers assign a unique sequence number to each original storage chip. Because the sequence number of the storage chip is set by original manufacturers and used to identify whether the storage chip is legal, the compatible storage chip provided on the compatible imaging cartridge can only use these legal sequence numbers, but the number of these legal sequence numbers is limited, it cannot be ensured that the sequence number on each compatible storage chip is unique, and thus it is difficult to avoid that the compatible storage chips with the same sequence numbers are successively installed on the same imaging device. Since the sequence number has been recorded by the imaging device after the first storage chip is installed on the imaging device, the subsequent storage chip with the same sequence number is determined as illegal when installed on the same imaging device. Obviously, it can cause that the imaging cartridge installed with these storage chips cannot be used, then such inexpensive compatible imaging cartridge cannot be used by the user, printing costs are greatly increased, a large amount of wastes occur.

In order to avoid these conditions, some compatible manufacturers design a storage chip for storing a plurality of different sequence numbers, set a jumper switch or a combined switch on the storage chip, which can select any of the sequence numbers through the jumper or a different combination of the switch. In this way, in use of the compatible imaging cartridge installed with such a storage chip, the user firstly select one of the sequence numbers, performs interactive communication with the imaging device with the selected sequence number, when the imaging device has recorded the sequence number in the memory of the imaging device, the sequence number is illegal, thus the storage chip cannot be accepted by the imaging device, and then the imaging device will notify the user via a display screen or by any other means. At this time, the user can take the imaging cartridge out of the imaging device, and select another sequence number by toggling the switch or setting the jumper. The above method is repeated until the sequence number in the storage chip is determined by the imaging device as legal, that is, brand new with respect to the imaging device.

Different types of imaging devices always record different numbers of sequence numbers, for instance, some imaging devices only can record one used sequence number of the storage chip, then the storage chip only need to store two different sequence numbers, and avoid that the sequence number is determined by the imaging device as illegal by means of constant rotation. However, some imaging devices can record tens of sequence numbers, and if selection is made by the jumper switch or the combined switch at this time, the selecting module will become exceptional bulky and complicated, which certainly will increase costs and manufacturing difficulty. Even though the storage chip only stores two sequence numbers, such a method for changing sequence numbers also needs to provide corresponding selecting module, since the storage chip is very fine, the selecting module generally can only be made compact, and it is inconvenient for the user to operate it. If selection only can be made after taking the chip out of the imaging cartridge, the operation becomes even more inconvenient.

SUMMARY

Accordingly, the present invention provides a storage chip, the storage chip can replace the sequence number in communication with the current imaging device in a convenient way, avoiding the problem that the storage chip cannot be used normally because the current sequence number has been recorded by the imaging device.

The present invention further provides a method of using the storage chip, which can replace the sequence number in communication with the current imaging device in a convenient way, avoiding the problem that the storage chip cannot be used normally because the current sequence number has been recorded by the imaging device.

In order to achieve the above objective, the technical solutions of the present invention are implemented as follows:

A storage chip for use in an imaging cartridge, the imaging cartridge is detachably installed in an imaging device, the storage chip includes a communication unit, a control unit and a storage unit, where, the communication unit is configured to receive information sent by the imaging device and send information to the imaging device;

the storage unit is configured to store at least mark information and information of multiple different serial numbers, an initial value of the mark information is information representing that the current sequence number is available;

the control unit is configured to judge whether the mark information stored by the storage unit is the initial value when a preset condition is detected, if yes, then take the currently-selected serial number information as a selected sequence number of the storage chip; if not, then select another sequence number from the information of multiple different serial numbers in the storage unit as a selected sequence number of the storage chip;

the control unit is further configured to judge whether the selected serial number is determined by the imaging device as legal according to a preset strategy, after sending serial number information to the imaging device, if yes, then remain the mark information as the initial value or update the mark information as the initial value; if no, then:

modify the mark information to be information representing that the current sequence number is unavailable when the mark information is information representing that the current sequence number is available; or remain the mark information constant when the mark information is information representing that the current sequence number is unavailable.

The present invention provides another storage chip for use in an imaging cartridge, the imaging cartridge is detachably installed in an imaging device, the storage chip includes a communication unit, a control unit and a storage unit, where, the communication unit is configured to receive information sent by the imaging device and send information to the imaging device;

the storage unit is configured to store at least information of multiple different serial numbers, and further store access mark information;

the control unit is configured to judge whether the access mark information is stored by the storage unit when a preset condition is detected, if not, then take the currently-selected serial number information as a selected sequence number of the storage chip; if yes, then select another sequence number from the information of multiple different serial numbers stored in the storage unit as a selected sequence number of the storage chip;

the control unit is further configured to store the access mark information in the storage unit, when sending serial number information to the imaging device; judge whether the selected serial number is determined by the imaging device as illegal according to a preset strategy, after sending serial number information, if yes, then remain the access mark information in the storage unit; if no, then delete the access mark information in the storage unit.

In additional embodiments, preferably, the preset strategy includes:

according to: received instructions or contents of instructions; or the number of instructions with matched ID information received by the storage chip within a preset time; or whether new instructions are received within a preset time.

In additional embodiments, preferably, the preset condition includes:

the imaging device performs power-on initialization to the storage chip; or the imaging device cutting off power supply of the storage chip is detected; or a reset signal sent by the imaging device is received; or a read instruction resent by the imaging device is received; or the imaging device maintaining power supply of the storage chip is detected, but a signal transmitted on a data line or a clock line remains constant; or an instruction relevant to initialization sent by the imaging device is received.

The present invention further provides an imaging cartridge being installed with any one of the above storage chip.

The present invention further provides a method of using any one of the above storage chip, and the method includes:

taking an imaging cartridge out of an imaging device and stopping performing read-write operation by the imaging device to the storage chip;

reinstalling the imaging cartridge on the imaging device, and performing, by the imaging device, power-on initialization to the storage chip and judging whether the storage chip is legal;

if the imaging device reminds that the imaging cartridge doesn't work normally, then taking the imaging cartridge out of the imaging device again, and reinstalling the imaging cartridge on the imaging device until the imaging device reminds that the imaging cartridge works normally.

The present invention further provides a method of changing a serial number of a storage chip, the storage chip stores at least mark information and information of multiple different serial numbers, an initial value of the mark information is information representing that the current sequence number is available, and the method includes:

judging whether the mark information stored by the storage chip is the initial value when a preset condition is detected, if yes, then taking the currently-selected serial number information as a selected sequence number of the storage chip; if no, then selecting another sequence number from the information of multiple different serial numbers in the storage chip as a selected sequence number of the storage chip;

judging whether the selected serial number is determined by the imaging device as legal according to a preset strategy, after sending serial number information to the imaging device, if yes, then remaining the mark information as the initial value or update the mark information as the initial value; if not, then:

modifying the mark information to be information representing that the current sequence number is unavailable when the mark information is information representing that the current sequence number is available; or remaining the mark information constant when the mark information is information representing that the current sequence number is unavailable.

The present invention further provides another method of changing a serial number of a storage chip, the storage chip stores at least information of multiple different serial numbers, and further stores access mark information, and the method includes:

judging whether the access mark information is stored by the storage chip when a preset condition is detected, if not, then taking the currently-selected serial number information as a selected sequence number of the storage chip; if yes, then selecting another sequence number from information of multiple different serial numbers stored in the storage chip as a selected sequence number of the storage chip;

storing the access mark information in the storage chip, when sending serial number information to the imaging device;

judging whether the selected serial number is determined by the imaging device as illegal according to a preset strategy, after sending serial number information, if yes, then remaining the access mark information in the storage chip; if no, then deleting the access mark information in the storage chip.

In the storage chip and the method of using the storage chip according to the present invention, since the storage unit stores information of multiple different serial numbers and mark information/access mark information about whether a currently-selected serial number is legal, and the control unit determines whether the serial number information sent to the imaging device is determined as legal according to a preset strategy and autonomously changes the selected serial number information when a preset condition is satisfied according to the determination result, so that the method of changing the serial number of the storage chip is more convenient, user experience is greatly improved and the problem that the storage chips are unusable because of the same serial number can be solved.

DESCRIPTION OF EMBODIMENTS

In order to make the objectives, technical solutions, and advantages of the present invention more comprehensible, embodiments accompanied with figures are described in detail below.

Embodiment 1

Figure 1:
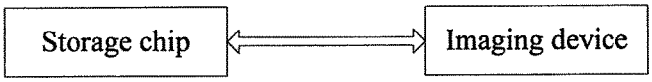
FIG. 1 is a schematic diagram of communication interaction between an imaging device and an imaging cartridge chip in the prior art.
Figure 2:
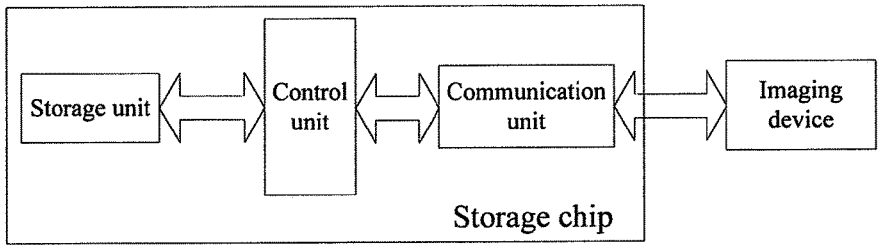
FIG. 2 is a schematic structural diagram of a storage chip according to an embodiment of the present invention.

The present invention provides a storage chip for use in an imaging cartridge, as shown in FIG. 2, the imaging cartridge is detachably installed in an imaging device, and the storage chip includes a communication unit, a control unit and a storage unit, where, the communication unit is configured to receive information sent by the imaging device and send information to the imaging device. The communication between the communication unit and the imaging device can be achieved in a wired connection, that is, in a connect manner, for example, bi-directional communication is conducted by connecting contacts on the storage chip and contacts on the imaging device; or in a wireless connection, that is, in a non-contact manner, for example, bi-directional communication is conducted via coils (antennas) on the storage chip and coils on the imaging device.

The storage unit is configured to store at least mark information and information of multiple different serial numbers, an initial value of the mark information is information representing that the current sequence number is available; besides, a factory-set value of the mark information can be configured as an initial value or not the initial value as required. The information of multiple different serial numbers mentioned in the present invention refers to information of two or more serial numbers. Although information of multiple different serial numbers is stored in the storage unit, but only one sequence number is selected as the current sequence number of the storage chip. The storage unit can adopt a common non-volatile memory, such as an EPROM, an EEPROM, a FLASH, a ferroelectric memory and a phase change memory, or adopt a solution of a volatile memory plus power supply, such as SRAM+a battery or a capacitor, DRAM+a battery or a capacitor.

The mark information is used to record whether the sequence number currently-selected by the storage chip is legal or not, if the mark information is an initial value, then the currently-selected sequence number is determined by the imaging device as legal, and belonging to an available sequence number. If the mark information is not the initial value, then the currently-selected sequence number is determined by the imaging device as illegal, and belonging to an unavailable sequence number, and thus the sequence number will not be accepted by the imaging device.

The information of multiple different serial numbers is generally obtained by reading data stored in the original storage chip, or obtained, after cracking rules for generating sequence numbers by the imaging device, through generating by the storage chip itself according to the rules, or stored in the storage chip after generating different serial numbers by a device for processing the storage chip according to the rules. In the present invention, the storage unit also can store change information during imaging operation of the imaging device, such as recording material residual/consumption and printing pages etc, and other unchanged information, such as recording material color, recording material capacity, manufacturing date, manufacturer code etc. As will be appreciated by persons skilled in the art, information stored in the storage unit of the present invention can be stored in different areas of the same memory respectively, or stored in multiple memories respectively. The storage unit in the present invention can be understood as one or more memories.

The control unit is configured to judge whether the mark information stored by the storage unit is the initial value when a preset condition is detected, if yes, then take the currently-selected serial number information as a selected sequence number of the storage chip; if no, then select another sequence number from information of multiple different serial numbers in the storage unit as a selected sequence number of the storage chip.

The preset condition includes any one of the following: the imaging device performing power-on initialization on the storage chip, or the imaging device cutting off power supply of the storage chip is detected, or a reset signal sent by the imaging device is received, or read instruction resent by the imaging device is received, or an instruction relevant to initialization sent by the imaging device is received, or a clock signal sent by the imaging device becoming faster or slower is detected, the imaging device maintaining power supply of the storage chip is detected, but a signal transmitted on a data line or a clock line remains constant. The instruction relevant to initialization includes an instruction of clearing a register and an instruction of reading all the data in the storage chip. There are a plurality of methods for generating the preset condition, for example, take the imaging cartridge out of the imaging device, and then reinstall the imaging cartridge on the imaging device; power off the imaging device, and then power on; open a protective cap of the imaging device (the imaging cartridge is installed below the protective cap) to notify the imaging device to replace the imaging cartridge, at this time, the imaging device stops powering on the storage chip, without taking out of the imaging cartridge, then cover the protective cap, the imaging device resumes powering on the storage chip; the imaging device reads information of the storage chip, and resend reading instructions if information abnormality occurs, and the like.

When the imaging device is switched off or the imaging cartridge is taken out of the imaging device, the imaging device will cut off power supply of the storage chip. When the imaging device is switched on or after the imaging cartridge is installed on the imaging device, the imaging device will power on the storage chip, power-on initialization will take place on the storage chip, such as zero clearing of a counter, an address pointer and so on. The control unit can be notified start and end of the power-on initialization according to these features. If the storage chip is also provided with a power supply, then the control unit also can perform data processing after the imaging device cuts off power supply of the storage chip. Therefore, the control unit is able to judge whether the mark information stored in the storage chip is the initial value, when the imaging device performing power-on initialization on the storage chip, or the imaging device cutting off power supply of the storage chip is detected. During the manufacturing process of the storage chip, one of the multiple different serial numbers is taken as an initially-selected sequence number. For example, it is assumed that information of 5 different sequence numbers is stored in the storage unit, and the information of 5 different sequence numbers is numbered, during the manufacturing process of the storage chip, the first serial number can be taken as an initially-selected sequence number. When the control unit needs to select another sequence number according to the judgment result, the second sequence number in an ascending order can be taken as the selected sequence number; when the fifth sequence number (the last one) is selected, then jump back to the first sequence number as the selected sequence number. Of course, this description is given for the sake of example only, the control unit can select another sequence number in various manners, and the present invention is not limited thereto.

The control unit is further configured to judge whether the selected serial number is determined by the imaging device as legal according to a preset strategy, after sending serial number information to the imaging device, if yes, then remain the mark information as the initial value or update the mark information as the initial value; if no, then:

Modify the mark information to be information representing that the current sequence number is unavailable, when the mark information is information representing that the current sequence number available; or remain the mark information constant when the mark information represents information that the current sequence number is unavailable.

Of course, like the control unit in the prior art, the control unit also has functions of interpreting and processing the received instructions, and receiving, storing and sending information.

Some imaging devices cut off power supply of the storage chip upon receiving an illegal sequence number, at this time, there may be a risk that the control unit fails to rewrite the mark information as information indicating the current sequence number is unavailable, therefore, a power supply unit may also be provided to supply power to the storage chip, thereby ensuring that there is enough power to rewrite the mark information. The power supply unit can be a battery, a capacitor or an inductor, or any other power supply, and can be provided on a storage chip, an imaging cartridge or any other place.

The control unit judges whether or not the selected serial number is determined by the imaging device as legal according to a preset strategy, in particular, the preset strategy can include the following methods:

1. The received instructions or contents of the instructions. Some imaging devices always write some information to the storage chip when judging that the sequence number of the storage chip is legal, such as the first installation date of the storage chip, confirmed recording material residual/consumption, information such as temperature/humidity of the current imaging device. Therefore, if the imaging device doesn't send a write instruction to the storage chip any more, after the storage chip sends serial number information to the imaging device, then the control unit of the storage chip can confirm the sequence number just sent has not been accepted by the imaging device, and the sequence number is illegal. This can be generally understood that the storage chip cannot recognize the machine.

Some imaging devices also write some information to the storage chip when judging that the sequence number of the storage chip is illegal, but the information is different from that when the sequence number of the storage chip is determined by the imaging device as legal. For example, write the first installation date of the storage chip or mark information such as unavailable chip to the storage chip when determined as illegal, and write newly detected or calculated recording material residual/consumption into the storage chip when determined as legal. Judge whether the selected serial number is legal by judging the type of the received instruction (read or write) or the content of the instruction.

2. The number of instructions with matched ID information received by the storage chip within a preset time. Since an imaging device is always provided with a plurality of imaging cartridges in order to meet the color imaging requirements, these imaging cartridges are additionally installed with storage chips, in order to reduce communication lines, the existing storage chip is always connected to the imaging device via the same signal bus, for purposes of distinction, a device address is generally set for each memory, or set according to a color/type of the recording material stored in the imaging cartridge, and these device addresses are identification information (Identification information, ID) when reflected on the storage unit. As such, all the instructions sent by the imaging device to the storage chip contain ID information, and upon receiving these instructions, the storage chip judges whether the ID information matches with the ID information stored in the storage chip itself, so as to determine whether the instructions are sent to itself. Some imaging devices also need to verify a logical function of the storage chip, when judging that the sequence number of the storage chip is legal, for example, first, the imaging device send a random number to the storage chip, then the storage chip processes the random number according to a preset arithmetic logic, then sends to the imaging device to allow the imaging device to verify the logical function of the storage chip. In the above process, the imaging device needs to send a plurality of instructions to the storage chip, and then the control unit can determine the selected serial number as legal according to the strategy that whether the number of the received instructions with matched ID information has reached 3 within a preset time, such as 2 seconds from the beginning of the power-on initialization.

3. Whether new instructions are received within a preset time. Some imaging devices does not send new instructions to the storage chip again when judging that the sequence number of the storage chip is illegal, and continues to send new instructions to the storage chip if it is legal. After the storage chip sends serial number information to the imaging device, the control unit starts timing, judges whether new instructions (if the instructions contain ID information, there is a need to judge whether the ID information matches with the ID information stored in itself, so as to determine whether the instructions are sent to itself) sent by the imaging device are received within a preset time, such as 2 seconds, if yes, then the control unit can confirm the sequence number just sent has been accepted by the imaging device, and the sequence number is legal, and this can be generally understood that the storage chip can recognize the machine.

In order to further describe the present invention, a specific embodiment is provided as an example for illustration.

It is assumed that the storage unit of the storage chip according to the present invention stores information of two different sequence numbers, which respectively are A123 and B456, A123 is taken as the current sequence number of the storage chip, the mark information is an initial value, indicating the current sequence number A123 is available. In the prior art, if the original storage chip storing the sequence number information of A123 has installed on the imaging device for normal use, when the recording material in the imaging cartridge runs out, the user takes the imaging cartridge out of the imaging device, and then the original storage chip storing the sequence number information of A123 is taken out at the same time. Then, the sequence number information of A123 has been recorded by the imaging device in a memory of the imaging device.

When the storage chip according to the present invention is installed on a compatible imaging cartridge or a waste imaging cartridge refilled with recording materials, and then installed on the aforementioned imaging device, as described above, since the mark information is an initial value, the control unit sends the selected sequence number A123 to the imaging device, and the sequence number information of A123 has been recorded by the imaging device, but the imaging device finds the two are the same after judging, considers the storage chip is illegal, and notifies the user of the information via a display screen on the imaging device or by any other means. After sending serial number information to the imaging device, the control unit judges that the selected serial number is determined by the imaging device as illegal according to a preset strategy, then rewrites the mark information as information indicating the current sequence number is unavailable.

Figure 3:
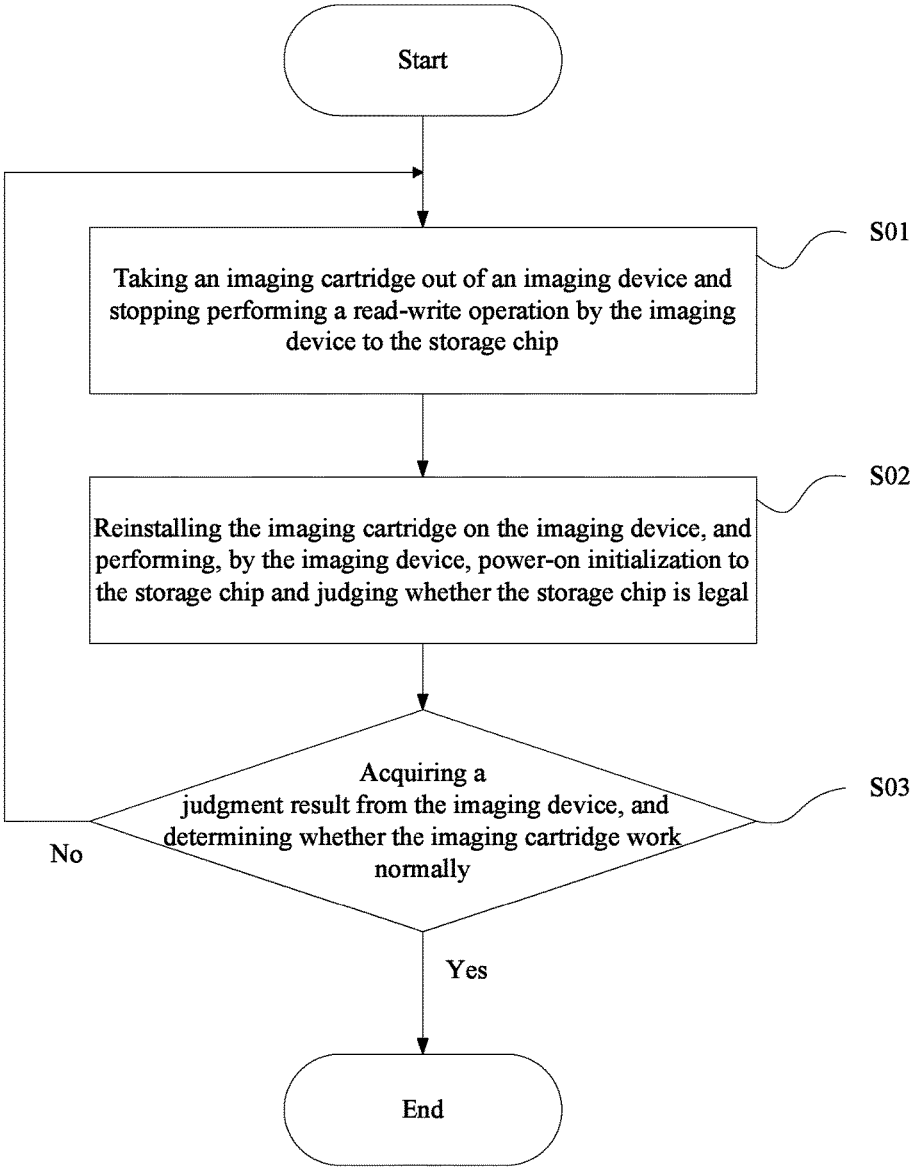
FIG. 3 is a flow chart of a method of using a storage chip according to an embodiment of the present invention.

Referring to FIG. 3, the description of the method of using the storage chip is given below. The user is notified that the storage chip is determined by the imaging device as illegal, then in step S01, taking the imaging cartridge out of the imaging device and stopping performing the read-write operation by the imaging device on the storage chip. Since the storage chip is generally not provided with a power supply, but powered by the imaging device, when the imaging cartridge is taken out of the imaging device, the storage chip loses power supply, and then the imaging device cannot perform the read-write operation on the storage chip. Even if the storage chip is provided with a power supply, the imaging device cannot perform the read-write operation on the storage chip due to disconnection of the lines, when the imaging cartridge is taken out of the imaging device. The storage chip is generally provided with a power switching circuit, and is notified whether the power supply to the storage chip is stopped by the imaging device via the power switching circuit. The power switching circuit is generally used to charge a power storage unit of the storage chip when the imaging device supplies power to the storage chip, such as power supply of the imaging device, however, when the imaging device cuts off power supply, the power storage unit supplies power to the storage chip, the power switching circuit particularly can be a unidirectional conducting element, such as a diode. As mentioned above, if the storage chip is provided with a power supply (or a power storage unit), then it is judged that whether the mark information stored by the storage unit is the initial value or not, when the imaging device stops power supply to the storage chip, and re-select the sequence number, that is, whether the current sequence number is continued to be selected as the selected sequence number or not is confirmed again. As seen from the above descriptions, the mark information stored by the storage unit has been rewritten by the control unit as information indicating the current sequence number is unavailable, then the control unit selects another sequence number from information of multiple different serial numbers in the storage unit as a selected sequence number of the storage chip, that is, selects B456 as the selected sequence number of the storage chip.

Step S02, reinstalling the imaging cartridge on the imaging device, and the imaging device performing power-on initialization on the storage chip and judging whether the storage chip is legal or not; if in step S01, the sequence number is not re-selected, when the imaging device stops power supply to the storage chip, then the control unit re-selects the sequence number when the imaging device performing power-on initialization on the storage chip is detected, that is, judges whether the mark information stored in the storage chip is the initial value at the time of power-on initialization. As seen from the above descriptions, the mark information stored by the storage unit has been rewritten by the control unit as information indicating the current sequence number is unavailable, then the control unit selects another sequence number from information of multiple different serial numbers in the storage unit as a selected sequence number of the storage chip, that is, selects B456 as the selected sequence number of the storage chip. Then, the information sent by the control unit to the imaging device according to instructions of the imaging device includes the sequence number information of B456. Since the sequence number information of B456 has not been recorded by the imaging device in the memory, and is brand new with respect to the imaging device, and therefore, the imaging device will judge the storage chip is legal at this time.

Step S03, acquiring a judgment result from the imaging device, if the imaging device reminds that the imaging cartridge doesn't work normally, then repeating steps S01 and S02 described above, that is, taking the imaging cartridge out of the imaging device again, and reinstalling the imaging cartridge on the imaging device until the imaging device reminds that the imaging cartridge works normally. Obviously, in this embodiment, since the imaging device has judged the storage chip as legal in step S02, then after sending serial number information to the imaging device, the control unit can judge that the selected serial number of B456 is determined by the imaging device as legal according to a preset strategy, therefore, the control unit will update the mark information as the initial value, that is, rewrite the mark information indicating the current sequence number is unavailable as the initial value.

Obviously, the method shown in FIG. 3 that the storage chip is used to achieve the purpose of replacing the selected sequence number uses one of plurality of methods for generating the preset condition, person skilled in the art may appreciate that, other methods for generating the preset condition can also be used to achieve the purpose of replacing the selected sequence number of the storage chip, that is, in a first step, perform operations to the imaging device to generate the preset condition; in a second step, the storage chip judges whether the mark information is the initial value, so that whether the current sequence number is continued to be selected as the selected sequence number is confirmed again; in a third step, acquire the judgment result of the imaging device, if the imaging device reminds that the imaging cartridge doesn't work normally, then the first and the second steps are repeated.

The present invention further provides a method of changing a serial number of a storage chip, where the storage chip stores at least mark information and information of multiple different serial numbers, an initial value of the mark information represents information that the current sequence number is available, and the method includes:

judging whether or not the mark information stored by the storage chip is the initial value when a preset condition is detected, if yes, then taking the currently-selected serial number information as a selected sequence number of the storage chip; if not, then selecting another sequence number from information of multiple different serial numbers in the storage chip as a selected sequence number of the storage chip;

judging whether or not the selected serial number is determined by the imaging device as legal according to a preset strategy, after sending serial number information to the imaging device, if yes, then remaining the mark information as the initial value or update the mark information as the initial value; if not, then:

Modifying the mark information to be information representing that of the current sequence number is unavailable when the mark information is information representing that the current sequence number is available; or remaining the mark information constant when the mark information represents information that the current sequence number is unavailable.

The "preset condition" and the "preset strategy" in this embodiment are the same as those in other embodiments of the present invention, which will not be repeated.

Embodiment 2

In Embodiment 1, when the storage chip sends a serial number to the imaging device, the sequence number is affirmed as legal first (that is, do not modify the mark information), then it is judged whether the sequence number is legal according to a preset strategy, and whether or not the current sequence number is continued to be selected as the selected sequence number according to the judgment result is confirmed again. The inventors of the present invention have found that the same problem also can be solved if some part of the steps is modified. That is, when the storage chip sends a serial number to the imaging device, the sequence number is considered as illegal first (that is, modify the mark information), then it is judged whether the sequence number is illegal according to a preset strategy, and whether or not the current sequence number is continued to be selected as the selected sequence number according to the judgment result is confirmed again. This embodiment is developed around such a modification.

This embodiment further provides a storage chip for use in an imaging cartridge detachably installed in an imaging device, similar to the above embodiments, the storage chip in this embodiment further includes a communication unit, a control unit and a storage unit, wherein, the communication unit is configured to receive information sent by the imaging device and send information to the imaging device;

the storage unit is configured to store at least information of multiple different serial numbers, and further store access mark information;

the control unit is configured to judge whether the access mark information is stored by the storage unit when a preset condition is detected, if not, then take the currently-selected serial number information as a selected sequence number of the storage chip; if yes, then select another sequence number from information of multiple different serial numbers stored in the storage unit as a selected sequence number of the storage chip;

In this embodiment, the control unit is further configured to store the access mark information in the storage unit, when sending serial number information to the imaging device; judge whether the selected serial number is determined by the imaging device as illegal according to a preset strategy, after sending serial number information, if yes, then remain the access mark information in the storage unit; if not, then delete the access mark information in the storage unit.

In this embodiment, the communication unit, the control unit and the storage unit can have the same structures with those in Embodiment 1, which will not be repeated. The above access mark information is equivalent to the rewritten mark information indicating the sequence number is not available in Embodiment 1, then if the access mark information is not stored in the storage unit, it means that the mark information stored in the storage unit is an initial value. Therefore, although the access mark information and the mark information in Embodiment 1 have different names, but they have the same function for recording whether the sequence number currently-selected by the storage chip is legal.

Figure 4:
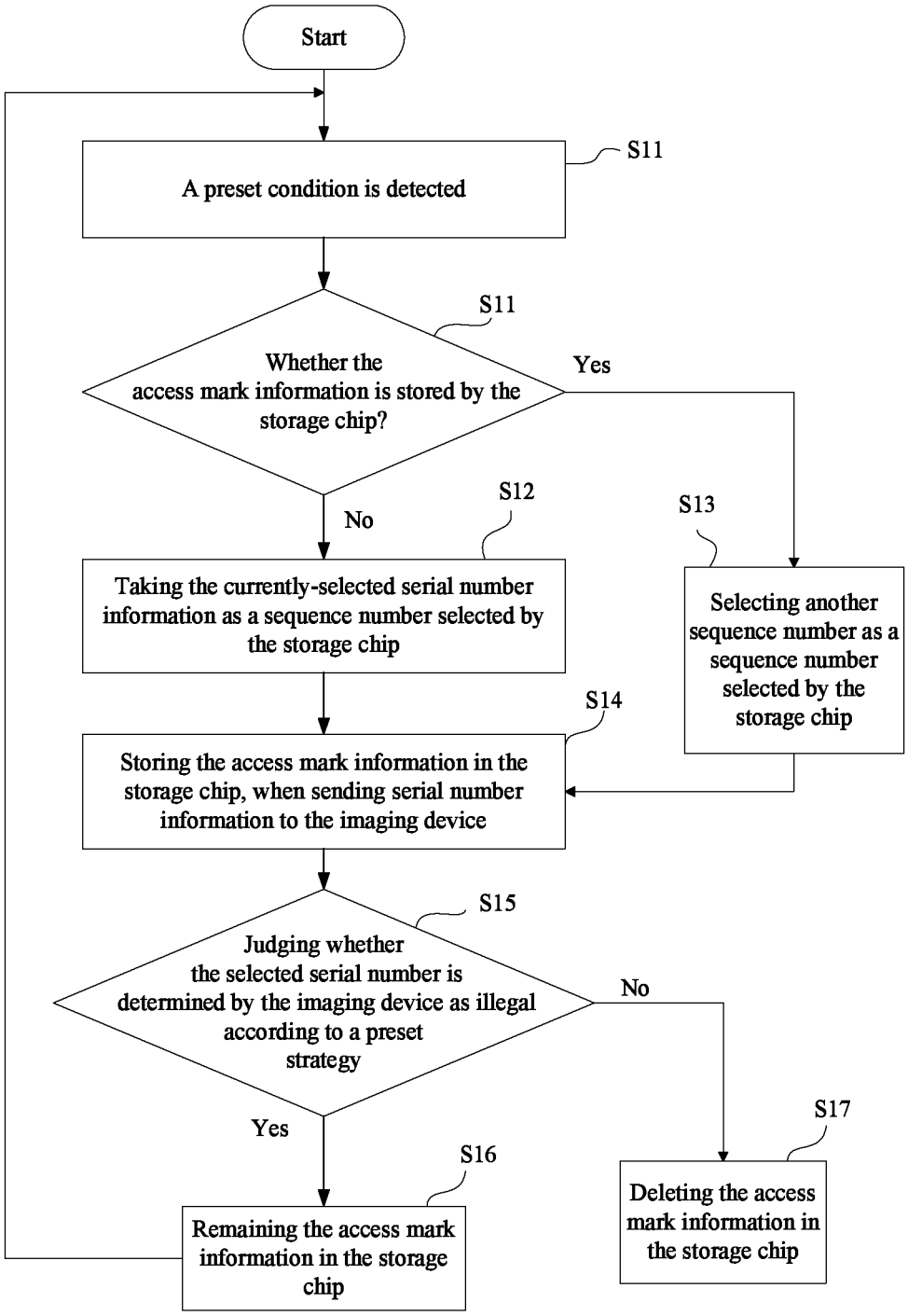
FIG. 4 is a flow chart of a method of changing a serial number of a storage chip according to an embodiment of the present invention.

The present invention further provides a method of changing a serial number of a storage chip, the storage chip stores at least information of multiple different serial numbers, and further stores access mark information, and as shown in FIG. 4, the method includes:

step S11, judging whether the access mark information is stored by the storage chip when a preset condition is detected, if not, then turn to step S12, taking the currently-selected serial number information as a selected sequence number of the storage chip; if yes, then turn to step S13, selecting another sequence number from information of multiple different serial numbers stored in the storage chip as a selected sequence number of the storage chip;

step S14, storing the access mark information in the storage chip, when sending serial number information to the imaging device;

step S15, judging whether the selected serial number is determined by the imaging device as illegal according to a preset strategy, after sending serial number information, if yes, then turn to step S16, remaining the access mark information in the storage chip; if not, then turn to step S17, deleting the access mark information in the storage chip.

The method referred in Embodiment 1 that the storage chip is used to achieve the purpose of replacing the selected sequence number is also applicable to the storage chip in this embodiment. The "preset condition" and the "preset strategy" in this embodiment are the same as those in other embodiments of the present invention, which will not be repeated.

In the present invention, the storage chip generally sends serial number information to the imaging device when an instruction of reading the sequence number is received from the imaging device, or when an instruction of reading all the data of the storage unit is received from the imaging device, or the storage chip actively sends serial number information to the imaging device within a preset time after the power-on initialization, different imaging devices have different features, and the present invention is not limited thereto.

The present invention further provides an imaging cartridge, being installed with the storage chip according to any one of the above embodiments.

It can be seen that, in terms of the storage chip provided in the present invention, when the storage chip is determined by the imaging device as illegal, it is not necessary to provide complicated selecting modules on the storage chip, the user doesn't need to toggle the switch or plug the jumper, after taking the imaging cartridge out of the imaging device, it is only needed to take the storage chip or the imaging cartridge out of the imaging device, and then reinstall it on the imaging device to replace the currently-selected sequence number information; or more simply, when the storage chip provided in the present invention is used, it is only necessary to power off the imaging device so as to stop powering on the storage chip, and then power on again so as to perform power-on to the storage chip, only by a two-step operation can the currently-selected sequence number information be replaced. These methods of use have a similarity that the imaging device is firstly operated through actions such as take-out, power-off or open-cap, so that the imaging device stops power supply to the storage chip or sends abnormal signals, and then the imaging device is operated through actions such as re-installation, power-on or cover-cap, so that the imaging device supplies power again to the storage chip or sends normal signals, the abnormal signal referred herein corresponds to the "preset condition", which includes a reset signal, an instruction relevant to initialization, a clock signal becoming faster or slower, repeated sending of the same instructions, the power supply is normal but the data line or clock line remains unchanged; the normal signal is a signal to perform information transmission according to a preset communication rule. Because the storage chip according to the present invention can capture these abnormal and normal signals, then the currently-selected sequence number can be replaced in a convenient way when a preset condition is satisfied. Such an operating manner is more convenient, user experience is greatly improved and the problem that the storage chips are unusable because of the same serial number can be solved.

The embodiments described above are merely preferred embodiments of the present invention and they do not limit the present invention. Any modification, equivalent replacement, and improvement made within the spirit and principle of the present invention fall within the scope of the present invention. As will be appreciated by persons skilled in the art, functional units or modules in the present invention can be implemented in part by a computer program, or by a dedicated hardware circuit, and the present invention is not limited thereto.

What is claimed is:

1. A storage chip for use in an imaging cartridge, wherein the imaging cartridge is detachably installed in an imaging device, the storage chip comprises a communication unit, a control unit and a storage unit, wherein, the communication unit is configured to receive information sent by the imaging device and send information to the imaging device;

the storage unit is configured to store at least mark information and information of multiple different serial numbers;

the control unit is configured to determine a state of the mark information stored by the storage unit when a preset condition is detected, in order to determine whether it is needed to replace a currently-selected serial number;

the control unit is further configured to judge whether it is needed to modify the state of the mark information after sending the selected serial number information to the imaging device.

2. The storage chip according to claim 1, wherein, the control unit is specifically configured to judge whether the selected serial number is determined by the imaging device as legal according to a preset strategy, and set the state of the mark information according to a judge result.

3. The storage chip according to claim 2, wherein, the control unit is further configured to judge whether the selected serial number is determined by the imaging device as legal according to the preset strategy, if yes, then set the mark information as a first state; if not, then set the mark information as a second state.

4. The storage chip according to claim 2, wherein, the preset strategy comprises:

received instructions or contents of instructions; or the number of instructions with matched ID information received by the storage chip within a preset time; or whether new instructions are received within a preset time.

5. The storage chip according to claim 1, wherein, the control unit is further configured to determine whether the mark information stored by the storage unit is in a first state when a preset condition is detected, if yes, then take the currently-selected serial number information as a selected sequence number of the storage chip; if not, then select another sequence number from the information of multiple different serial numbers in the storage unit as a selected sequence number of the storage chip.

6. The storage chip according to claim 1, wherein, the preset condition comprises:

the imaging device performs power-on initialization to the storage chip is detected; or the imaging device cutting off power supply of the storage chip is detected; or a reset signal sent by the imaging device is received; or a read instruction resent by the imaging device is received; or the imaging device maintaining power supply of the storage chip is detected, but a signal transmitted on a data line or a clock line remains constant; or an instruction relevant to initialization sent by the imaging device is received.

7. An imaging cartridge being installed with the storage chip according to claim 1.

8. A method of using the storage chip according to claim 1, comprising:

taking an imaging cartridge out of an imaging device and stopping performing read-write operation by the imaging device to the storage chip;

reinstalling the imaging cartridge on the imaging device, and performing, by the imaging device, power-on initialization to the storage chip and judging whether the storage chip is legal; and if the imaging device reminds that the imaging cartridge doesn't work normally, then taking the imaging cartridge out of the imaging device again, and reinstalling the imaging cartridge on the imaging device until the imaging device reminds that the imaging cartridge works normally.

9. A method of using the storage chip according to claim 1, comprising:

opening a protective cap of an imaging device and stopping supplying power by the imaging device to the storage chip;

covering the protective cap of the imaging device, and resupplying, by the imaging device, power to the storage chip and judging whether the storage chip is legal; and if the imaging device reminds that the imaging cartridge doesn't work normally, then opening the protective cap of the imaging device again, and then covering the protective cap until the imaging device reminds that the imaging cartridge works normally.

10. A method of changing a serial number of a storage chip, wherein the storage chip stores at least mark information and information of multiple different serial numbers, and the method comprises:

determining a state of the mark information stored by the storage chip when a preset condition is detected, in order to determine whether it is needed to replace a currently-selected serial number;

judging whether it is needed to modify the state of the mark information after sending the selected serial number information to the imaging device.

11. The method of changing a serial number of a storage chip according to claim 10, wherein, judging whether it is needed to modify the state of the mark information specifically includes, judging whether the selected serial number is determined by the imaging device as legal according to a preset strategy, and setting the state of the mark information according to a judge result.

12. The method of changing a serial number of a storage chip according to claim 11, wherein, judging whether the selected serial number is determined by the imaging device as illegal according to the preset strategy, if yes, then setting the mark information as a first state; if not, then setting the mark information as a second state.

13. The method of changing a serial number of a storage chip according to claim 11, wherein, the preset strategy comprises:

received instructions or contents of instructions; or the number of instructions with matched ID information received by the storage chip within a preset time; or whether new instructions are received within a preset time.

14. The method of changing a serial number of a storage chip according to claim 10, wherein, determining whether the mark information stored by the storage chip is in a first state when a preset condition is detected, if yes, then taking the currently-selected serial number information as a selected sequence number of the storage chip; if not, then selecting another sequence number from information of multiple different serial numbers stored in the storage chip as a selected sequence number of the storage chip.

15. The method of changing a serial number of a storage chip according to claim 10, wherein, the preset condition comprises:

the imaging device performs power-on initialization to the storage chip is detected; or the imaging device cutting off power supply of the storage chip is detected; or a reset signal sent by the imaging device is received; or a read instruction resent by the imaging device is received; or the imaging device maintaining power supply of the storage chip is detected, but a signal transmitted on a data line or a clock line remains constant; or an instruction relevant to initialization sent by the imaging device is received.

* * * * *